United States Patent [19]

Lodrick, Sr.

[11] Patent Number: 4,690,657

[45] Date of Patent: Sep. 1, 1987

[54] MAGNETICALLY ACTUATED AMUSEMENT DEVICE

[76] Inventor: Lawrence E. Lodrick, Sr., 2436 Harrison Ave., North, Rochester, Mich. 48063

[21] Appl. No.: 740,328

[22] Filed: Jun. 3, 1985

[51] Int. Cl.[4] ..... A63H 33/26; A63B 71/00; A63F 1/18

[52] U.S. Cl. ..... 446/134; 273/141 A; 273/1 M

[58] Field of Search ..... 446/129-137; 273/141 A, 1 M; 434/301; 40/426

[56] References Cited

U.S. PATENT DOCUMENTS

| | | | |
|---|---|---|---|
| 1,257,045 | 2/1918 | Stotler | 273/141 A |
| 2,220,049 | 10/1940 | Dunmore | 446/136 X |
| 3,196,566 | 7/1965 | Littlefield | 446/129 X |
| 3,478,466 | 11/1969 | Conner | 446/131 |
| 3,707,290 | 12/1972 | Birnkrant | 273/141 A |
| 4,011,674 | 3/1977 | Jacobson | 273/1 M |
| 4,178,707 | 12/1979 | Littlefield | 446/129 X |
| 4,211,414 | 7/1980 | Moodt | 273/141 A |
| 4,250,659 | 2/1981 | Ishiguro | 446/133 |
| 4,432,544 | 2/1984 | Wakimura | 446/136 X |

*Primary Examiner*—Robert A. Hafer
*Assistant Examiner*—Terrence L. B. Brown
*Attorney, Agent, or Firm*—Basile, Weintraub & Hanlon

[57] ABSTRACT

An amusement device comprising first and second magnetic members; the first magnetic member being freely-movable in a base and the second magnetic member suspended from a tether and support arm attached to the base to a position within the influence of the first magnetic member. The second magnetic member is secured at one end to the tether in a manner by which the repulsive interaction between the two magnets maintains the second magnetic member essentially parallel to the base and perpendicular to the tether. The second magnetic member is freely rotatable around the point of tether attachment such that movements of the first magnetic member cause corresponding changes in the rotational orientation of the second magnetic member.

9 Claims, 4 Drawing Figures

MAGNETICALLY ACTUATED AMUSEMENT DEVICE

BACKGROUND OF THE INVENTION

This invention refers to amusement devices particularly those employing magnetic flux fields to create cantilevered indicators.

The attractive and repulsive properties of magnets are known. Similarly, magnets have been employed for various purposes in the prior art. U.S. Pat. No. 4,211,414 employs a magnetically influenced pointer. U.S. Pat. No. 1,257,045 illustrates an arm supported random pointer. Similarly, U.S. Pat. No. 3,707,290 illustrates a filament supported random pointer. All known magnetic pointers and amusement devices demonstrate a captive magnetic influence which is to say that, when they come to rest, there is positive magnetic attraction north to south or magnet to metal. Also, their actions are very limited due to the stopping effects of such attractions in the devices described.

To date, no magnetic amusement device or pointer has been found that actually utilizes the direction of flow of the magnetic flux fields to achieve a cantilever thus permitting the actual floating of a portion of one magnet within the flux field of a second, influencing magnet. Thus, it has been impossible to create an amusement device in which variations in the flux field exerted by one magnet would result in changes in the orientation of another influencing magnet. Employing such principals would yield a desirable, interesting and innovative amusement device.

Accordingly, it is desirable to provide an amusement device which uses opposing magnetic fields to suspend or cantilever one magnet within the field exerted by another.

It is also desirable that the suspended magnet be freely movable about a central point and the orientation of the other magnet be movable to exert changing influences on the influenced magnet. It is also desirable that the principal so discovered be used to achieve a directional pointer through slight changes in the relationship of the elements involved.

It is also desirable that extremely minor repositioning of the base magnet influences pointer direction.

SUMMARY OF THE INVENTION

The present invention relates to an amusement device employing a first magnetic member movably held in a base and a second magnetic member suspended above the base by a support arm and tether attached to the base. The second magnetic member is positioned within sufficient proximity to the base so that slight movements of the first magnetic member within the base are translated to directional movements of the magnetic member suspended above. The second magnetic member suspended above the base is tethered such that it is free to rotate about the central point of the base within the magnetic influence exerted by the first magnetic member. The flux field exerted by both magnets serve to maintain the second magnetic member in a position essentially parallel to the base.

BRIEF DESCRIPTION OF THE DRAWINGS

In the drawings, like reference numbers refer to like parts throughout the several views, wherein.

DESCRIPTION OF THE PREFERRED EMBODIMENT

Figure 1:
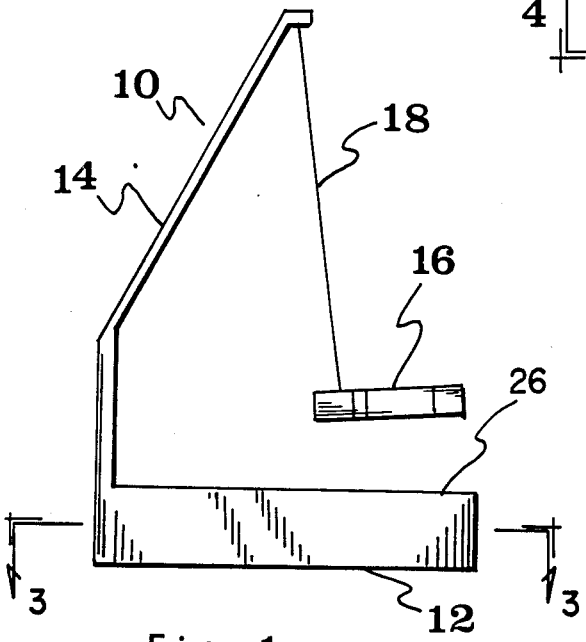
FIG. 1 is a side elevational view of the present invention.
Figure 2:
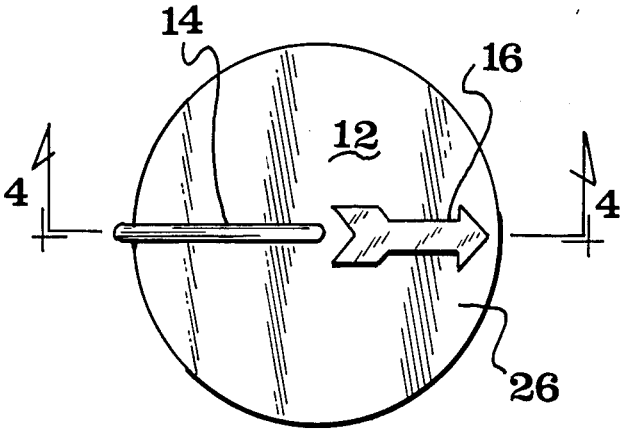
FIG. 2 is a plan elevational view of the amusement device of the present invention.
Figure 4:
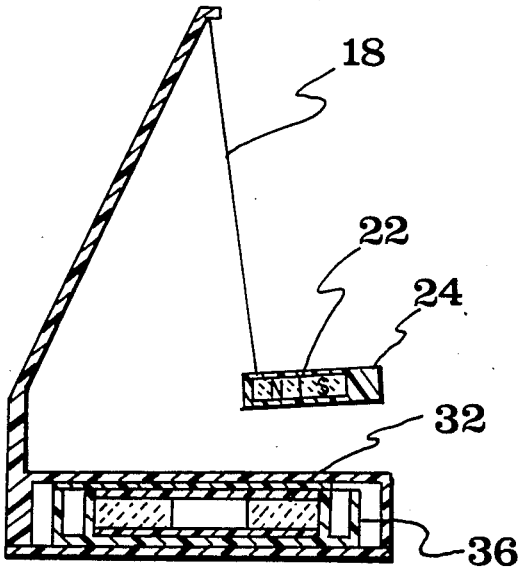
FIG. 4 is a cross-sectional view taken along line 4—4 of FIG. 2.
Figure 3:
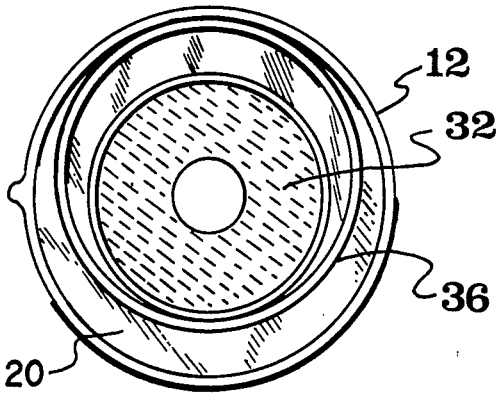
FIG. 3 is a cross-sectional view taken along the line 3—3 of FIG. 1.

Referring now to the drawing, there is illustrated in FIG. 1 represents an amusement device 10 made according to the present invention. The amusement device 10 has a base 12 which contains a magnetic means 32 (seen in FIGS. 3 and 4) composed of a large washer magnet upon which a non-magnetic support arm 14 is perpendicularly attached. The non-magnetic support arm 14 is attached to the side of the base 12 and extends perpendicularly upward therefrom to allow clearance for a magnetic pointer 16 which is suspended from a tether means 18 attached to the upper-most end of the support arm 14. The support arm 14 extends perpendicularly upward from the base 12 to terminate at a point centrally oriented above the base. The tether 18 is attached to a magnetic pointer 16 at a position approximate to the north pole of the bar magnet. The magnetic pointer 16 is then permitted to swing freely and twist around tether means 18. In the preferred embodiment, tether means 18 may be made of any suitable fiber or string. The magnetic field exerted by the base 12 maintains the magnetic pointer 16 in a horizontal, position in which the magnetic pointer 16 will cantilever around the tether attachment point. In the preferred embodiment the magnetic pointer is a bar magnet 22 housed in a suitable covering material 24.

The cantilevered nature of the bar magnet pointer 16 is due to the repulsive properties of the bar magnet pointer 16 and magnetic means 32 housed in base 12. The tether 18 does not permit the northern polarity of the magnetic pointer 16 to be displaced toward the south polarized magnetic means 32 despite their normal magnetic attraction for each other. In turn, magnetic means 32 repells the southern polarity of the magnetic pointer 16 thereby creating the forces required to cantilever the magnetic pointer 16 maintaining it in an orientation essentially parallel to the base 12 and overcoming the gravitational forces acting on magnetic pointer 16.

The magnetic flux fields of magnetic means 32 support and retain the bar magnet pointer 16 through its 360° rotation around the vertical center line, passing through tether attachment 18.

In the preferred embodiment, the magnetic pointer 16 and magnetic means 32 are positioned at a distance to optimize the magnetic repulsion between the two.

In the preferred embodiment, the base 12 has an internal cavity 20 of sufficient width to permit free lateral movement of the enclosed magnetic means 32; a conventional washer magnet. In the preferred embodiment, the internal cavity 20 is circular. The base 12 may also contain an ring 36 which surrounds the magnetic means 32. The diameter of the internal cavity 20 is sufficiently large to permit free movement of both eccentric 36 and the magnetic means 32 encapsulated therein. Interaction of magnetic means 32, ring 36 and internal cavity 20 permits the magnetic means 32 to be repositioned with regard to the orientation of the base 12. Changes in this orientation of magnetic means 32 and the flux field exerted thereby will affect the orientation of bar magnet pointer means 16.

Movement of the first magnetic means 32 within the base will affect the radial orientation of the bar magnetic pointer 16. The surface 26 of the base 12 which faces the magnetic pointer 16 can be equipped with a suitable face or dial such that movement of the first magnetic means 32 results in changes in orientation of the magnetic pointer 16 to point to different humorous suggestions contained on the surface 25 of base 12. It can be seen that an infinite number of random positions around the center of the magnetic means 32 can be achieved in relation to the central point through tether means 18 which will force the magnetic pointer 16 to seek a corresponding infinite number of random positions as well.

Having thus described the preferred embodiment of the present invention what is claimed is:

1. A magnetically cantilevered pendulously supported amusement device comprising:

a base;

an enclosed chamber disposed within the base;

a first magnet having north and south poles on the opposite faces thereof contained within the enclosed chamber;

a second magnet having north and south poles on the opposite ends thereof, pendulously supported above the base at one end thereof;

wherein the polarity of the other, free end of the second magnet is the same as and repulses the polarity of the upper face of the first magnet and the strength of the repulsion between the first and second magnets is sufficient to at least balance the force of gravity acting to pull the free end of the second magnet down, thereby causing the free end to be cantilevered up and disposed at least as high as the supported end;

wherein the first magnet is capable of free lateral movement within the enclosed chamber and is displaced therein in response to movement of the base, said displacement causing a change in position of the free end of the second magnet;

wherein the enclosed chamber contains means for permitting movably and randomly positioning of the first magnet; and wherein the positioning means comprises at least one ring larger than the first magnet but smaller than the chamber such that the at least one ring can move freely and randomly within the chamber and the first magnet can move freely within the at least one ring.

2. The amusement device of claim 1 wherein the first magnet is a washer magnet.

3. The of claim 1 wherein the chamber is essentially circular and has a height sufficient to permit free lateral movement of the at least one ring and first magnet therein.

4. The amusement device of claim 3 wherein the at least one ring has an essentially circular configuration.

5. The amusement device of claim 1 wherein the second magnet is a bar magnet.

6. The amusement device of claim 5 wherein the bar magnet is rotatably movable about the tether such that re-orientation of the first magnet within the base in response to the movement of the base re-orients the position of the bar magnet around the tether.

7. The device of claim 1 further comprising:

a support arm having first and second ends, the first end of the support arm connected to the base such that the support arm extends upward therefrom, and an upwardly extending tether attached at one end to the second end of the support arm and at the other end to the second magnet.

8. The device of claim 1 further comprising a patterned face comprised of various indicia disposed on an upper face of the base, wherein the displaced position of the free end of the second magnet may be read from the corresponding indicia on the patterned face.

9. A magnetically cantilevered, pendulously supported amusement device comprising:

a base;

an essentially circular enclosed chamber disposed within the base;

at least one essentially circular ring smaller than the enclosed chamber and contained therein such that at the least one ring can move freely and randomly within the enclosed chamber;

a washer magnet having north and south poles on the opposite faces thereof contained within the enclosed chamber and within the at least one ring and capable of free movement therein, wherein the chamber has a height sufficient to permit free and random movement of the at least one ring and the washer magnet therein;

a support arm having first and second ends, the first end of the support arm being connected to the base such that the support arm extends upward therefrom;

a bar magnet having north and south poles on the opposite ends thereof pendulously supported above the base at one end thereof by an upwardly extending tether having first and second ends, the first end of the tether being attached to the one end of the bar magnet and a second end being attached to the second end of the support arm, wherein the polarity of the free end of the bar magnet is the same as and repulses the polarity of the upper face of the washer magnet and the strength of the repulsion between the washer and bar magnets is sufficient to at least balance the force of gravity acting to pull the free end of the magnet down, thereby causing the free end to be cantilevered up and disposed at least as high as the supported end; and a patterned face including various indicia disposed on an upper face of the base, wherein, when the first magnet is displaced within the ring and enclosed chamber, in response to movement of the base, said displacement causes a change in position of the free end of the second magnet and the displaced position thereof may be read on the corresponding indicia on the patterned face.

* * * * *